United States Patent [19]

Merlo

[11] Patent Number: 4,665,373

[45] Date of Patent: May 12, 1987

[54] SMALL SIZE WAVEGUIDE SWITCHING DEVICE

[76] Inventor: Michele Merlo, Via Monterosa 61, 20100 Milan, Italy

[21] Appl. No.: 758,444

[22] Filed: Jul. 24, 1985

[30] Foreign Application Priority Data

Jul. 25, 1984 [IT] Italy ..... 22052 A/84

[51] Int. Cl.[4] ..... H01P 1/10

[52] U.S. Cl. ..... 333/106; 310/68 B

[58] Field of Search ..... 333/105, 106, 108, 107; 335/4, 5; 310/68 B; 200/153 S

[56] References Cited

U.S. PATENT DOCUMENTS

| | | | |
|---|---|---|---|
| 2,999,213 | 9/1961 | Olivieri et al. | 333/106 |
| 3,419,827 | 12/1968 | Webb | 333/106 |
| 4,088,908 | 5/1978 | Gumen et al. | 310/68 B X |
| 4,143,287 | 3/1979 | Biggs | 307/311 |
| 4,370,631 | 1/1983 | Gerber et al. | 333/106 |
| 4,520,331 | 5/1985 | Steidel | 333/106 X |
| 4,568,834 | 2/1986 | Sherman et al. | 307/311 X |
| 4,570,079 | 2/1986 | Davis | 307/311 |

*Primary Examiner*—Paul Gensler

*Attorney, Agent, or Firm*—Oblon, Fisher, Spivak, McClelland & Maier

[57] ABSTRACT

A small size waveguide switch having a stationary body with four mutually perpendicular sides and a port on each side. A rotor is mounted on the body and has two coupling arc-shaped symmetrical channels, along with a mechanism for alternately bringing the rotor to two switching positions where the channels of the rotor differently connect in pairs the ports. The driving mechanism is a d.c. motor consisting of a permanent magnet coupled to one end of the rotor, and a toroidal stator associated with the stationary body and having polar shoes and energizing coils supplied with a direct current with the direction being set by the status of optoelectronic devices.

6 Claims, 12 Drawing Figures

SMALL SIZE WAVEGUIDE SWITCHING DEVICE

BACKGROUND OF THE INVENTION

The present invention relates to a waveguide switching device comprising: a body with four ports located on four mutually perpendicular sides thereof. A rotor member mounted in this body and provided with two circle arc symmetrical channels having an opening which is substantially 90° and a cross section substantially coinciding with the cross-section of the ports and driving means for bringing the rotor member to two switching positions so the channels selectively connect with the ports.

As is known, waveguide switches are provided with a substantially cube-shaped metal body including on four mutually perpendicular faces, a rectangular shape port, a waveguide being coupled to each of the ports. At the central portion of the body there is mounted a substantially cylindrical rotor provided with two 90° circle arc symmetrical channels having a like cross section to that of the ports. These switches further comprise driving means causing the rotor to connect said ports in different ways, in pairs, through said channels; in other words at a switching position the waveguides are coupled in pairs according to a given way through the rotor channels whereas at the other switching position said ports are coupled differently.

An ideal switch of the above mentioned type would have a zero switching time as well zero losses. Moreover it would be provided with an infinite insulation and driving means as small as possible.

On the other hand, presently known switches have comparatively long switching times, high losses and large size which negatively affects their use in aircraft applications. In general prior art switches have switching times on the order of 1/10 sec.; insertion losses which, instead of being zero, amount to several hundred dB; a standing wave ratio of the order of 1.05 (whereas an ideal ratio would be 1) and an isolation of the order of 60 dB (whereas it should be infinite).

Moreover the overall size, which would ideally coincide with that of the metal cube, is much larger than the metal cube size, frequently over two times as large, because of the volume required by the electric motors provided for driving and braking the rotor.

The long switching time and large size are such greatly limit, in actual practice, the use of mechanical switching device. In fact, as a high switching speed an/or small size are required, solid state switches are used which, while they operate with very high speeds, have losses much greater than those of the mechanical switches.

SUMMARY OF THE INVENTION

Accordingly, the main object of the present invention is to provide a waveguide switching device, of the above mentioned type, having a very reduced switching time, small losses and an overall size corresponding to the size of the cube to be inserted between the flanges of the four waveguides to be switched, that is such a switching device which may be used in a broader application range than that of presently known switching devices.

According to one aspect of the present invention, the above object, as well as yet other objects which will become more apparent from the following detailed description, are achieved by a switching device, of the above mentioned type, which is essentially characterized in that the electric motor means comprise a d.c. electric motor including a permanent magnet coupled to an axial end of the rotor, and a toroidal stator associated with the body and having pole shoes and energizing coils supplied by a direct current the direction whereof is determined by the status of optoelectronic means.

According to a further important aspect of the present invention, in order to prevent the rotor from undesirably bouncing as it arrives at one or the other switching positions thereof, a beating or striking mass is included in the switch, having preferably the same weight as the rotor. The rotor transfers by collision its kinetic energy to this beating or striking mass as it approaches either of the switching positions thereof.

BRIEF DESCRIPTION OF THE DRAWINGS

The invention will become more apparent thereinafter from the following detailed description, given by way of an indicative but not limitative example, of a preferred embodiment thereof, being illustrated in the accompanying drawings, where.

DESCRIPTION OF THE PREFERRED EMBODIMENT

Figure 1:
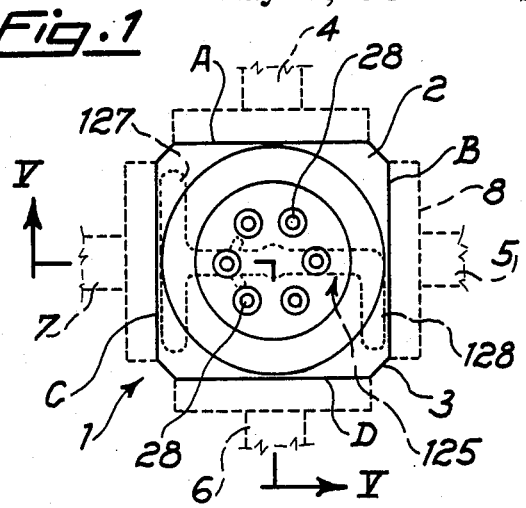
FIG. 1 is a plan top view of the switching device and the four waveguides converging thereon.

With reference to FIG. 1, the waveguide switching device, indicated at 1, comprises a substantially cube shaped stationary body 2 (with beveled corners 3).

On the four sides A,B,C and D of the body 1, perpendicular to the drawing sheet and to one another there are provided with like rectangular ports A',B',C' and D' (see FIGS. 2 and 3) having perpendicular axis to their respective sides. The axis of the mentioned ports are all contained on a same plane parallel to the drawing sheet of FIGS. 1, 2 and 3. The small size of the ports is indicated at L and is shown in FIGS. 2 and 3.

With each face A,B,C,D there is coupled a waveguide 4,5,6 and 7 through an end flange 8 and screw means, not shown. More specifically, the waveguides are aligned with the ports A',B',C' and D' and have similar cross-sections.

The four ports A',B',C' and D' lead to a central hole 9, where there is arranged a cylindrical rotor 10. The rotor is provided with two symmetrical channels 11 and 123, having the same cross-section as that of the ports A',B',C' and D' and arranged so that in the two switching positions thereof, as shown in FIGS. 2 and 3, the end openings of said channels coincide with the ports. The geometrical axis of the two channels 11, 12 extend on a 90° circle arc. The centers of the channel end openings lay on the same plane as the geometrical axis of the ports A',B',C' and D'. In other words, that in the two switching positions each end opening of the channels 11, 12 coincide with one of the ports.

Figure 2:
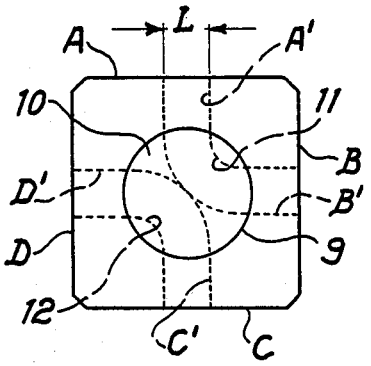
FIGS. 2 and 3 are schematic plan top views illustrating the two switching positions of the switching device.
Figure 3:
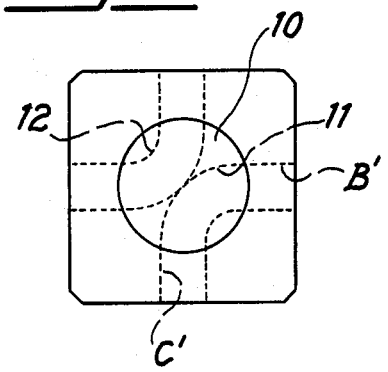

At the switching position of FIG. 2, the channel 11 connects the two ports A',B' (and therefore the waveguides 4 and 5) whereas the other channel 12 connects the two ports C',D' (and therefore the waveguides 6,7). By turning the rotor 10 in either direction (by means of an electric motor which will be illustrated and discussed below) the switching position of FIG. 3 is achieved with the channel 11 connects the ports B',C' and the channel 12 the remaining ports.

In order to reduce to a minimum the radial size of the rotor (see FIG. 4), upon having set the width or small side "L" of the waveguide cross section, and therefore of the door and channel, the radius R of the rotor 10 is selected in such a way as to slightly exceed the value $$\frac{L}{2 \sin 22° 30'}$$

R will then preferably correspond to $$\frac{1.15}{2 \sin 22° 30'}$$

so that L exceeds the value by 15% which has been determined experimentally. After having set L, the minimum radius (Rmin) circumscribes an octagon with a side corresponding to L that is obtained from the relationship.

$$R \min = \frac{L}{2 \sin 22° 30'}$$

Figure 4:
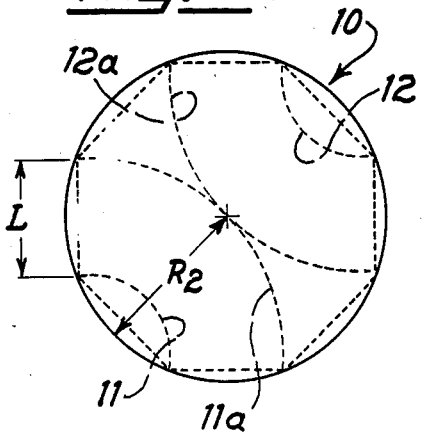
FIG. 4 is a schematic plan view of the rotor and better illustrates the criterion used for reducing as far as possible the radial size of the rotor.

In such a circle, on the other hand, the traces of the channel innermost walls would be tangent; which is not acceptable since the two channels must be phsyically separated from one another, that is a material thickness should be provided between the adjoining walls of the two channels, as it is shown in FIG. 4. It is sufficient to provide a minimum thickness. In order to obtain a suitably small thickness, the rotor radius is to set in such a way as to exceed by about 15% the Rmin value.

With reference to the remaining figures of the drawings, it should be noted that, from the constructional point of view, the body 2 comprises a main portion 2A (see in particular FIG. 5) including, in its central axial hole 9, the rotor 10. Said main portion 2A comprises, at the top and bottom thereof, enlarged regions 20 and 21, the first whereof has a circular profile, whereas the second has a square profile with beveled corners. The mentioned enlarged regions are closed by covers 22,23 connected, by screws (not shown), to the main portion 2A, with the covers being provided with resilient annular seals 24.

More specifically, the cover 22 has in its center a central cylindrical lug 25 having a seat with the ball bearing 26 mounted therein. In this bearing 26 there is arranged an axis spindle for the rotor 10.

The cover 22 further comprises a plurality of circularly arranged holes 127 (see FIG. 5), an innerly threaded bushing, made of metal, 28 which is force fitted into each of said holes through the interposition of an insulating small tube 29. Said bushing is terminated at the bottom thereof by a contact pointed member 30, which is designed to be inserted between the resilient contact endpiece 31 which is at the end portions of plug members 32 and is supported by a disc shaped insulating base 33 thereon which is formed with the printed circuit of the waveguide switch.

The base 33 is held apart from the inner face of the cover 22 by means of spacers 40, which are fixed to the cover by means of studs 41 and which, with their small diameter bottom threaded end pass through holes as formed through said base 33. On the projecting portion of the mentioned end there is screwed a stop nut 42. A further spacer consists of an insulating material cap, perforated at the center thereof, and indicated at 45, interposed between said cover and base.

The top wall of the cover 22 is provided with an insulating material disc or layer 43.

Figure 8:
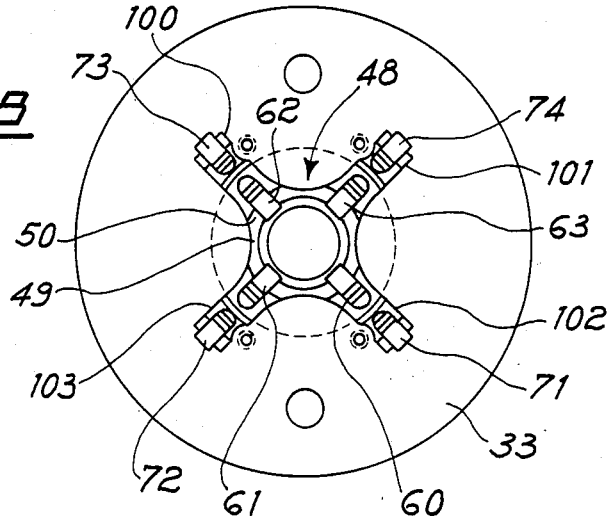
FIG. 8 is a bottom view of the unit or assembly including the optoelectronic means, as taken along the line VIII—VIII of FIG. 5, with the switch shown in a broken away condition.

The base 33 is perforated at the center thereof and through said hole there extends the tubular lug 46 of a supporting member 48 (see also FIG. 8), terminating at the bottom with four radially extending arms 100,101,102,103, arranged at 90° from one another. The tubular lug 46 is force fitted on the cylindrical lug of the cover 22.

Figure 5:
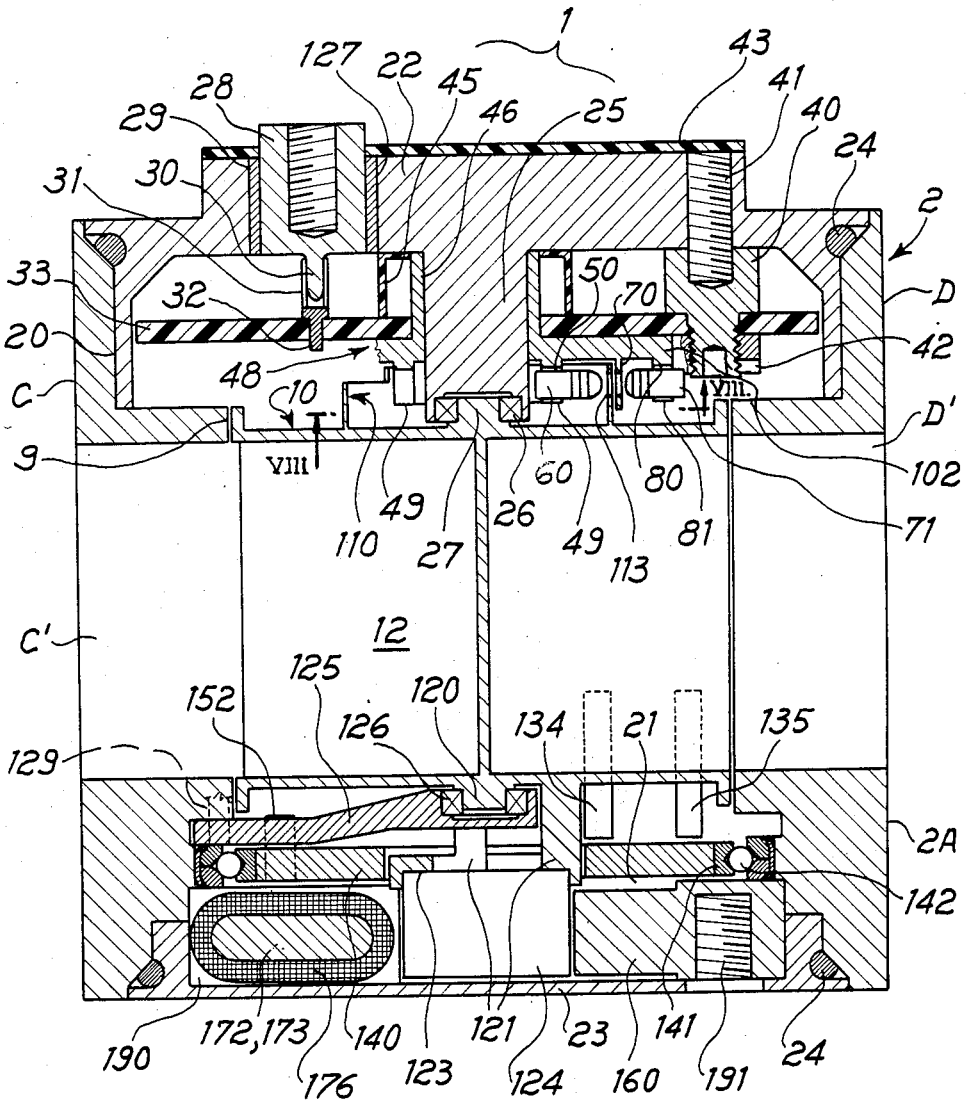
FIG. 5 is a cross-sectional view as taken along the line V—V of FIG. 1, with parts broken away for clarity.

At the start of said radially extending arms, but at a given distance from the lug 25, the supporting member 48 is provided with an edge 49 interrupted by axially extending slots 50 at each arm 100,101,102,103. In each said slot there is affixed, by way of an adhesive, a infrared light emitting diode respectively 60,61,62 and 63. Each arm 100–103 is provided, at an intermediate position, with a perforated screen 70 which is turned downward (as shown in FIG. 5) and each hole is aligned with a light emitting diode and a phototransistor 71,72,73,74. The diodes and phototransistors are electrically coupled with the printed circuit on the base 33. These phototransistors are affixed, by means of an adhesive, in slots 80 that are formed on edges 81, directed downward and provided at the free ends of each arm 100–103.

Figure 6:
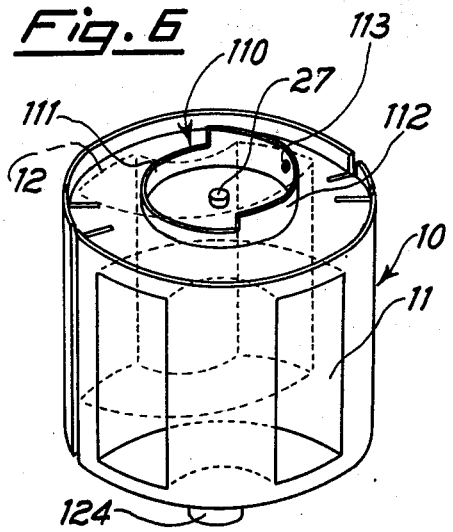
FIGS. 6 and 7 illustrate a perspective view of the rotor, as taken according to two different angles.
Figure 7:
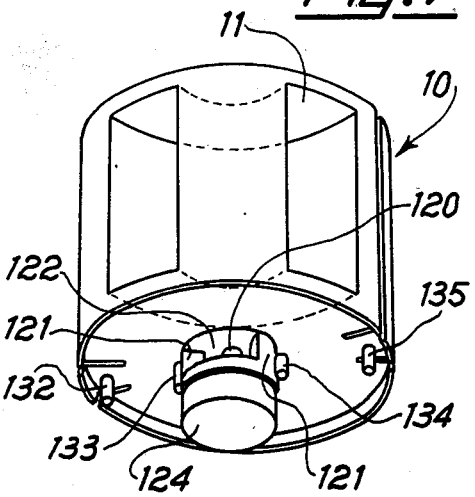

The rotor 10 (see also FIGS. 6 and 7) is provided, concentrically to its top supporting pin 27, with an edge 110 including two different height portions 111, 112. The portion 111 does not interpose between the photodiodes and transistors, whereas the high height portion 112, as it is interposed therebetween, blocks the phototransistor. At the middle of the portion 112 there is formed a hole 113. At one of the switching positions, said hole 113 is aligned with the photodiode-phototransistor pair 60,71 (see FIG. 5) whereas at the other switching position it is aligned with the 63,74 pair.

The angular opening of the small height portion 111 of the edge 110 is set at 150°. At a switching position, the 62,73 pair will be interrupted by the portion 112, whereas the other pair (61,72) will be actuated, since it will be arranged in the front of the small height portion 111 of the edge. Under these conditions, as (see FIG. 12) the "T" point is coupled to the "−" by means of an outer switch as driven, for example, by a radar therein there is mounted by waveguide switching device according to the invention, the motor driving the rotor 10, and which will be disclosed thereinafter, will be supplied in such a way as to bring saids rotor to the other switching position thereof. During the shifting from one to the other switching positions, the small height portion 111 of the edge 110 will be brought in front of both the 62/73 and 61/72 pair, thereby, as it will become more apparent thereinafter, the electric motor supply will be switched off, and the motor will continue by inertia towards its other switching position. Upon having reached that position, the high height portion 112 will blind the 61/72 pair, whereas the low height portion 111 will be arranged in the front of the other pair (62,73), thereby the motor, as the "N" point is coupled to the "−" by means of an outer switch, will be supplied in such a way as to cause the rotor to be driven in an opposite direction, to bring it again to the starting switching position. Then that operation repeats with a continuous shifting of the rotor from one switching position to the other, as driven by the outer switch.

The rotor 10 (see FIGS. 5 and 7) is provided, at the bottom and middle portion thereof, with a pivot pin 120. Moreover, at a given distance from said pin 120, it is provided with a pair of axially extending arms 121, defining a diametral passage 122 and formed, at their ends, with a respective circular housing or seat 123 therein a cylindrical permanent magnet 124 is glued.

More specifically, said magnet is diametrically magnetized.

In the opening 122 defined between the two arms 121 there is threaded a supporting bracket 125 (see also FIG. 1 illustrating the bracket in order to better represent the cross-sectional view of FIG. 5), formed at the center with a seat therein there is arranged a thrust ball bearing 126, rotatably supporting the pivot spindle 120 of the rotor 10. More specifically said supporting bracket 125 is provided at the ends thereof (see FIG. 9), with two different cross perforated arms 127,128 placed through said bracket that is coupled to the main portion 2A of the body 2 by way of the screws 129 (FIG. 5). The arm 128 extends on a single side of the bracket 125 in order to allow for said bracket to be threaded through the opening 122 of the rotor 10. The bracket 125 is provided, on the side facing its arm 127, with two lateral lugs 130,131 of circle arc shape. Those lugs act as abutments for the rotor 10. In fact said rotor is provided (see FIG. 7), along a same diameter, with four pins 132,133,134,135 two whereof (133,134) adjoin said rotor center, whereas the other two (132,135) are arranged near the periphery of said rotor. The arrangement of the pins 133,134 (see FIG. 9) being such that at one of the switching positions the pin 133 co-operates with the lug 130 to stop the rotor 10, whereas at the other switching position the pin 134 abuts against the lug 131.

The outer pins 132 and 135 of the rotor 10 act (as it will become more apparent below) in such a way as to transfer the kinetic energy of the rotor to a rotatable disc 140 (i.e. the beating or striking mass) in order to prevent the rotor 10 arm from bouncing as the pins 133,134 impact against the corresponding lug 130,131 of the bracket 125.

The rotatable metal disc 140 is arranged under the bracket 125 and is perforated at its center and has a weight substantially equal to that of the rotor 10. This disc 140, moreover, is rigid with respect to the inner ring 141 holding a ball bearing 142.

The disc 140-bearing 142 assembly is force fitted into suitable region of the axial hole of the main portion 2A of the body 2.

Figure 9:
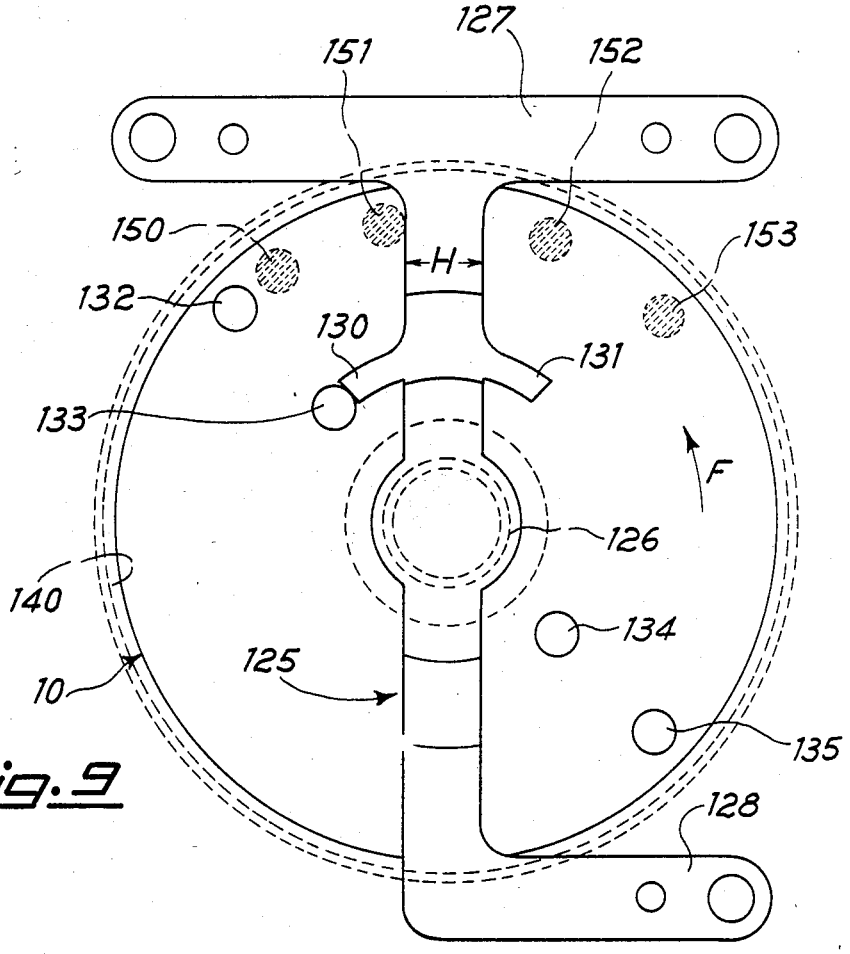
FIG. 9 is a bottom view illustrating the bracket for supporting the lower end of the rotor, and ilustrating by a broken line details preceding said bracket, that is arranged thereunder.

The disc 140, moreover, is peripherally provided with four axial pins 150,151,152,153 (see in particular FIG. 9 wherein these pins are shown by the dashed lines). These pins are upwardly turned, and are arranged along a circle arc and spaced apart from one another. Two of said pins are located on a side of the bracket 125 and the other two are arranged on the other side thereof, the spacing of the pins 151 and 152 being greater than the width H of the bracket 125. The pins 150 and 152 are arranged in the path of the pins 132 and 135 of the rotor 10 and have such a height that they are impacted by the latter. The pins 151,152 have such a height (see FIG. 5) that they impact against the sides of the bracket 125.

FIG. 9 illustrates the positions of the above mentioned pins (pertaining both to the rotor 10 and the disc 140) at one of the switching positions. From the shown position, the electric motor rotates the rotor in the arrow F direction towards the other switching position. A little before the contact of the rotor pin 134 and lug 131, the rotor pin 135 will abut the pin 153 of the disc 140 and therefore the kinetic energy of the rotor 10 will be transferred to the disc 140 which will stop as its pin 152 abuts the side of the bracket 125. The rotor pin 134 will abut the lug 131 in a smooth way, without bouncing. As it should be apparent, the pins 151 and 150 will be moved away from the bracket 125 and and set for performing a like function as the pins 151 and 152 as the electric motor will rotate the rotor 10 in an opposite direction to bring it again to the preceding switching position.

Figure 10:
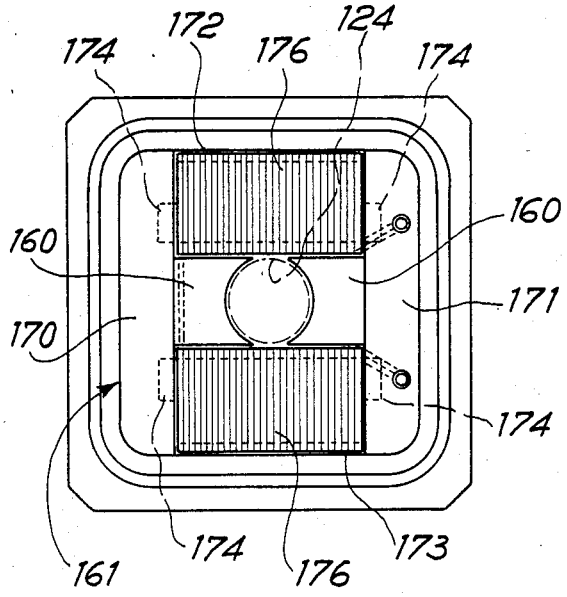
FIG. 10 is a top view of the switch lower or bottom cover, with the stator portion of the electric motor.
Figure 11:
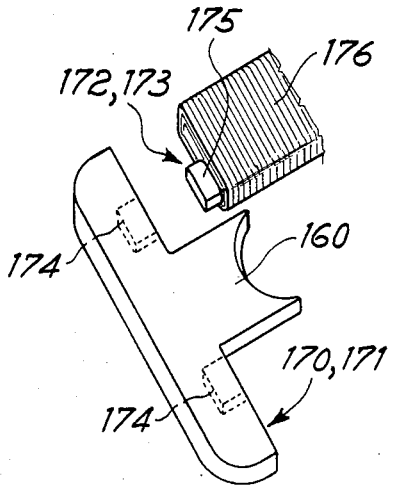
FIG. 11 is a partial perspective view illustrating the stator portion of the electric motor.

More specifically the electric motor used for driving the rotor 10 (see FIGS. 5, 10 and 11) is a d.c motor and the rotor thereof consists of the permanent magnet 124, which is arranged between two polar shoes 160 of a rectangular or squared magnetic circuit 161, formed by the four components of metal material 170,171,172,173, being equal by pairs.

The components 170,171 are of substantially T-shape and comprise the polar pieces 124 and, on the sides whereof, notches 174 thereinto there are threaded end lugs 175 of corresponding shapes which laterally project from the other two rectilinear components 172,173. On each of the latter there is wound a respective energizing coil 176, the two coils being series coupled (see the diagram of FIG. 12) and wound in such a way as to produce adding magnetic fluxes in the polar shoes 160.

The stator structure (160,170,171,172,173,175,176) of the electric motor is mounted in the cover 24, i a seat 190 correspondingly shaped thereof, and is coupled to said cover by screws 191.

Figure 12:
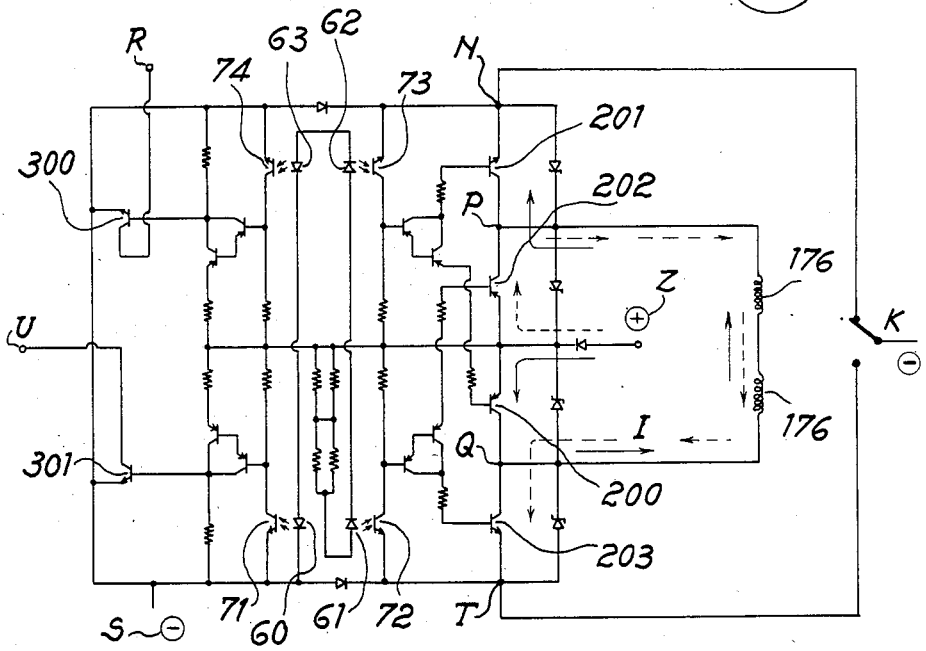
FIG. 12 is a schematic electrical diagram of the switching device according to the present invention.

With reference also to the electric diagram of FIG. 12, the operation is as follows.

Assumes that the switch has achieved one of its switching positions, and the outer switch K in its position coupling the "−" with the point N. In this condition, the photodiode 62 will light the phototransistor 73, whereas the photodiode/phototransistor pair 61/72 will be unactuated since it will be shut off by the high height portion 112 of the edge 110 as provided on the rotor 10.

Thus the transistors 200,201 will be switched on and the transistors 202,203 will be switched off. The current I will flow as indicated by the solid line arrows from the positive pole Z to the negative pole N. Thus, the coils or windings 176 of the electric motor will be energized and the rotor 10 will be rotated to the other switching position.

As the outer switch is switched to the position coupling the "T" point to the "—" and with the 61/72 pair in an actuated condition because of the moving away of the high height portion 112 from the rotor edge 110, the transistors 202 and 203 will switch on and the rotor will return to the preceding position. The transistors 300 and 301 will be alternatively switched on as the hole 113 will be alternatively arranged in front of the pairs 63/74 and 60/71/Thus the consequent signals at the terminals R and U will be used for detecting the switching positions of the switch.

I claim:

1. A wave guide switch comprising:

a d.c. motor having a flat toroidal-like stator and a rotor, wherein said rotor has two coupling arc-shaped symmetrical channels formed therein;

a stationary body having four mutually perpendicular faces each with a port therein arranged so as to be in alignment with the ends of the channels formed in said rotor which is contained therein, such that each of said two coupling channels can form a microwave waveguide thru said switch;

a rotatable striking mass having approximately the same mass as said rotor and attached thereto in such a manner that upon said channels approaching a completed waveguide path said striking mass absorbs the kinetic energy caused by the motion of said rotor; and optoelectronic means coupled to said d.c. motor to provide positioning information so as to position said rotor's channels such that they form said microwave path's.

2. A switch according to claim 1, wherein said optoelectronic means comprises a shaped screen rigid with said rotor, and at least two angularly spaced read-out means each of which comprise radiating beam generating means; means for receiving said beam and means for converting said received beam into an electric signal.

3. A switch according to claim 2, wherein said stationary body comprises a first cover thereon there is mounted the stator of said electric motor.

4. A switch according to claim 1 wherein said rotor comprises first pivot pins supported in a plurality of ball bearings, wherein one of said bearings being mounted on an asymmetrical bracket coupled to said stationary body.

5. A switch according to claim 4, wherein said rotor further comprises a second pin axially projecting and arranged on the same diameter as said first pivot pins for abutting against said bracket which define the switching positions of said switch.

6. A switch according to claim 4 wherein said striking mass consists of a centrally perforated disc peripherally mounted on a ball bearing, said disc being peripherally provided with four axially projecting pins, spaced apart from one another, with two of said pins arranged on a side of said bracket and two on the other side of said bracket, with the outermost of said pins being effective to be impacted upon by said d.c. motor and the innermost pins are effective to stop said striking mass by cooperating with said bracket.

* * * * *